United States Patent [19]

Waldo et al.

[11] 4,332,407

[45] Jun. 1, 1982

[54] AUTOMATICALLY LOCKING CROSSBOLT DEADLOCK

[75] Inventors: Russell W. Waldo, St. Paul; George L. Engstrom, Minneapolis, both of Minn.

[73] Assignee: Ideal Security Hardware Corporation, St. Paul, Minn.

[21] Appl. No.: 103,068

[22] Filed: Dec. 12, 1979

[51] Int. Cl.[3] ..... E05C 3/10

[52] U.S. Cl. ..... 292/161

[58] Field of Search ..... 292/DIG. 26, DIG. 24, 292/158, 161, 160, 335

[56] References Cited

U.S. PATENT DOCUMENTS

| | | | |
|---|---|---|---|
| 1,038,512 | 9/1912 | Anderson | 292/DIG. 24 |
| 3,912,309 | 10/1975 | Fischer et al. | 292/335 X |
| 4,061,383 | 12/1977 | Waldo | 292/335 |

*Primary Examiner*—Richard E. Moore

*Attorney, Agent, or Firm*—Merchant, Gould, Smith, Edell, Welter & Schmidt

[57] ABSTRACT

An automatically locking crossbolt deadlock (2). Deadlock (2) includes a vertically movable crossbolt (36) which may be moved between locked and unlocked positions. A lock button (200) is movable between a first position in which the lock button (200) positively holds crossbolt (36) in its locked position and a second position in which crossbolt (36) is free to move. A drive lever (43) is provided for moving crossbolt (36) between its locked and unlocked positions. Lock button (200) is moved from its first to its second position upon rotation of a handle (130) so that a panic exit may be accomplished without manually unlocking lock button (200). In addition, lock button (200) is movable to a third position for holding crossbolt (36) in its unlocked position to provide an anti-lock out feature. Rotatable handle (130) includes a lock cylinder (63) therein.

8 Claims, 7 Drawing Figures

21
19
156

162
160
160
41
30
212
164
174
170
63c
182
168
30
210
206
168
172
156
22

19
20

120
120
800
136
140
30
144
146
208
134
138
148
120
30
120

AUTOMATICALLY LOCKING CROSSBOLT DEADLOCK

TECHNICAL FIELD

This invention relates to a door lock of the prime entry type, i.e. a lock which is the primary mechanism for securing a door or other closure member against unauthorized opening. More particularly, this invention relates to an automatically locking crossbolt deadlock. As such, this invention may be utilized to secure doors, e.g. usually of a conventional type hinged along one side to a door frame, to prevent intruders from entering a house or other building in which the door is contained.

DESCRIPTION OF THE PRIOR ART

A lock is in general any type of device which is able to secure a door, window, or other closure member in a building or structure in a closed position. The reasons why locks are required need not be stated in detail. Suffice it to say that it is usually desirable to prevent unauthorized access to one's home or business for reasons of safety and crime prevention.

Older types of locks which have been used on doors comprise what can be referred to as "key in knob" locks. In such locks, a lock cylinder is contained inside the rotatable knob which is used to open the door. This lock cylinder when actuated was operative to lock the bolt of the door in place and prevent the knob from being turned. Unfortunately, such "key in knob" locks were relatively easy to defeat or "jimmy." They could be quickly opened by someone having knowledge of the manner in which to overcome the lock. This then required that auxiliary locks or other deadlocks be installed on the door for security reasons. The use of such auxiliary locks can be expensive and, therefore, is disadvantageous.

Other locks have been developed which improve upon the "key in knob" locks from a security standpoint. One lock of this type is the automatically locking crossbolt deadlock described and illustrated in U.S. Pat. No. 4,061,383. The invention described in this patent was invented by the inventor of the present invention and is assigned to the assignee of the present patent application. The crossbolt deadlock described in this patent comprises a deadlock mounted on a door and a cooperating strike mounted on a door frame. The deadlock included a vertically movable crossbolt which could be moved from an unlocked position to a locked position. In its locked position, bolt portions on the crossbolt are received inside cooperating lugs on the strike to lock the door in place. A suitable operating mechanism was provided for moving the crossbolt from one position to the other to lock or unlock the door. The deadlock did not have any rotatable handles for imparting movement to the operating mechanism for the crossbolt. Rather, this movement was derived solely from the movement of keys in various lock cylinders and the consequent rotation of various portions of the lock cylinders. Two lock cylinders were provided so that the deadlock was of the double cylinder type.

One desirable feature of the crossbolt deadlock of this prior patent was a safety lock button. This lock button could be moved into a locking position when the door was closed to hold the crossbolt in its locked position. This, in effect, locked out all keys because the crossbolt could not be moved to an unlocked position even assuming one had a key. It was first required that the lock button be moved to an unlocking position where it did not cooperate with the crossbolt such that the crossbolt could be moved by operation of the lock cylinder. In addition, the lock button could also be moved back to its locking position when the door was opened to hold the crossbolt in its unlocked position. This is desirable because then subsequent closure of the door would not cause the crossbolt to automatically relock as would be the case if the lock button were still in an unlocking position. To hold the crossbolt in either the locked or unlocked positions, the lock button had a locking lug which would cooperate respectively with either one of two vertically spaced notches in the crossbolt body.

While the crossbolt deadlock of the prior patent was effective in securing the door, it had a number of disadvantages. For one thing, in order to open the door when the door was closed and the lock button was in its locking position, the locking button first had to be manually moved from its locking position to its unlocked position by sliding the lock button laterally. The door could then be opened by operation of the lock cylinders. The need for the manual movement of the lock button could be disadvantageous in a "panic exit" where the person who is trying to unlock the door is panicked and not thinking clearly. For example, in a fire or other emergency requiring prompt exit from a dwelling, especially when the person trying to operate the door might be injured or incapacitated, the mere fact that a manual operation has to be performed before the door could be opened is disadvantageous.

In addition, in order to prevent yourself from being locked out with the above-noted lock, it is always necessary after opening the door to move the lock button back into its locking position to hold the crossbolt in its retracted position. Thus, when opening the door, one first had to move the crossbolt from its locking to its unlocking position by sliding the lock button in one direction, and then after opening the door to immediately and manually move the lock button back to its locking position by sliding it back in a reverse direction. Again, the need to move the lock button back is disadvantageous since the person operating the door might not always think of it, especially after having once moved the lock button to open the door. In addition, the fact that the lock button has to be moved back in exactly the reverse direction of the direction in which it was first moved would contribute to people tending to forget to move the lock button into the proper position. Thus, some people, especially those who are forgetful which is a trait that appears more frequently in elderly people, might forget to move the lock button back to its locking position after opening the door. In such a case, if the door shuts behind them, then the crossbolt would automatically relock and they would be locked out. Unless they had a key with them, this would require the use of a locksmith to regain entry to the house. This, of course, is expensive.

One final disadvantage with crossbolt deadlocks of the type known previously is that none of these utilized a rotatable handle which also incorporated in it a lock cylinder. For example, the crossbolt deadlock illustrated in the above patent utilized rotatable lock cylinders to operate the crossbolt. The handles by which the door was opened and closed were fixed. Other crossbolt deadlocks are known in which rotatable handles are used to actuate the operating mechanism for the crossbolt. In all such handles known to Applicant, however, no lock cylinders have ever been employed.

SUMMARY OF THE INVENTION

Accordingly, it is one aspect of the present invention to provide an automatically locking crossbolt deadlock of the type noted above not having the disadvantages thereof. More particularly, it is an aspect of this invention to provide a crossbolt deadlock which allows a panic exit and which also automatically moves the lock button to a position in which the person opening the door cannot be locked out. Furthermore, it is yet another aspect of this invention to provide a crossbolt deadlock having a rotatable handle which also incorporates a lock cylinder therein.

The automatically locking crossbolt deadlock of this invention is of the type which has a crossbolt movable between an unlocked and locked position. A lock button is also movable between a first position in which the crossbolt is held in its locked position and a second position in which the crossbolt is free to move between its locked and unlocked positions. Means are provided for moving the crossbolt between the locked and unlocked positions and includes a rotatable handle. This invention relates to an improvement of the lock button which comprises means for moving the lock button from its first to its second position upon rotation of the handle, whereby movement of the lock button is automatically effected upon rotation of the handle to allow unlocking of the crossbolt without the need for manually moving the lock button between its first and second positions. Preferably, the rotation of the handles also moves the lock button to a third position in which the crossbolt is held in its unlocked position so that an anti lock-out feature is also provided.

The present invention also relates to an automatically locking crossbolt deadlock of the type noted above which also includes a housing having a front face. A recess is provided in the front face of the housing which recess receives a rotatable handle. The rotatable handle includes means for operating a locking mechanism contained inside the housing, i.e. the crossbolt. The handle of the deadlock of this invention is improved and includes a lock cylinder contained inside a hub of the handle. The lock cylinder has a locking pin movable towards and away from the front face of the housing upon operation of the lock cylinder. The recess of the front face of the housing includes an opening into which the locking pin is received for preventing rotation of the handle. Rotation of the handle is allowed only when the locking pin is removed from the opening.

BRIEF DESCRIPTION OF THE DRAWINGS

This invention will be described hereafter in greater detail in the Detailed Description, when taken in conjunction with the following drawings, in which like reference numerals refer to like elements throughout.

DETAILED DESCRIPTION

Figure 1:
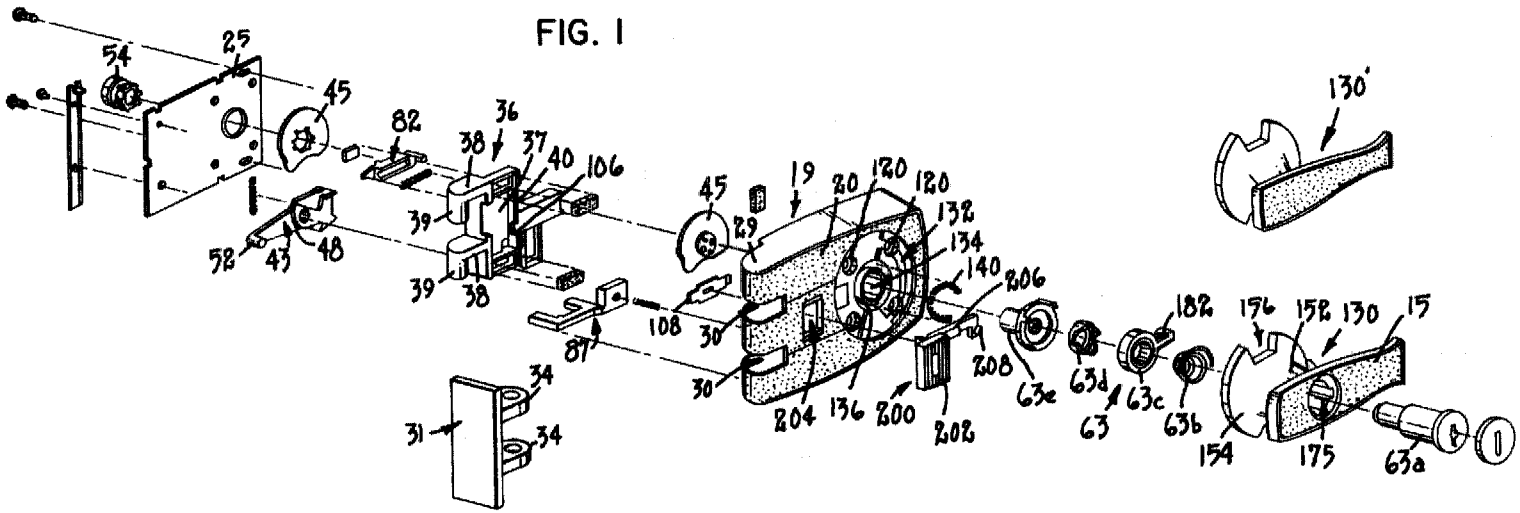
FIG. 1 is an exploded perspective view showing an improved automatically locking crossbolt deadlock according to this invention, particularly illustrating the components thereof and the manner in which they interfit together.

An improved automatically locking crossbolt deadlock according to this invention is generally illustrated as 2. Deadlock 2 is an improved version of the automatically locking crossbolt deadlock illustrated and described in U.S. Pat. No. 4,061,383, issued to Russel W. Waldo, the inventor of the present invention, on Dec. 6, 1977. The aforementioned patent is hereby incorporated by reference with regard to details of the construction and operation of those components of deadlock 2 which are identical to the components of the deadlock shown in the prior patent. In fact, the same reference numerals will be used, insofar as is possible, to refer to those elements of deadlock 2 which have identical counterparts in the deadlock of the above-noted patent. While the above-noted patent should be referred to for a complete description of the operation of deadlock 2, the construction and operation of deadlock 2 will be described herein insofar as is necessary for an understanding of the present invention.

Deadlock 2 comprises a housing 19. Housing 19 includes a nose portion 29 that is cut-away to provide a pair of vertically spaced apart slot-like notches or openings 30. Nose portion 29 is adapted to interfit with a strike 31 that includes a pair of vertically spaced apart lugs 34. Strike 31 is suited to be secured rigidly to a portion of a door frame (not shown) in any manner which is conventional in the art. Similarly, housing 19 is suited to be rigidly secured to the door itself (not shown) by means of threaded securing members such as mounting screws or bolts (not shown). These securing members pass through holes or apertures 120 in housing 19 and are then secured in one face of the door. When properly aligned relative to one another, lugs 34 of strike 31 will be received in the notches 30 of housing 19 whenever the door is closed in the door frame. Preferably, strike 31 and housing 19 are mounted to the interior side of the door frame and door such that the front face 20 of housing 19 is accessible from the interior of the building.

Deadlock 2 also includes a vertically movable crossbolt 36. Crossbolt 36 is generally identical to the crossbolt disclosed in the above-mentioned patent with one difference. Crossbolt 36 includes a vertically extending rail 40 in the crossbolt body 37. Rail 40 is received in a guide channel 41 formed on the inside surface of front wall 20 of housing 19. Crossbolt 36 as disclosed herein is provided with only one notch 106 in rail 40 whereas the crossbolt of the afore-mentioned patent application had two vertically spaced notches in rail 40. The reason for this difference will be described hereafter.

Crossbolt 36 includes two vertically extending bolt portions 39 secured to arms 38 which project laterally from crossbolt body 37. Bolt portions 39 are contained in nose portion 29 and are vertically movable into notches 30. In this position, bolt portions 29 are received inside lugs 34 of strike 31 to lock the door in the door frame when the door is closed. Thus, crossbolt 36 is vertically movable in housing 19 from a first position, called the locked or strike engaging position, in which bolt portions 39 extend into the notches 30, and a second position, called the unlocked or non-strike engaging position, in which the bolt portions 39 are retracted back into nose portion 29 and are not received in notches 30. Thus, the basic locking action of deadlock 2 is brought about by vertical reciprocation of crossbolt 36 in housing 19.

Figure 2:
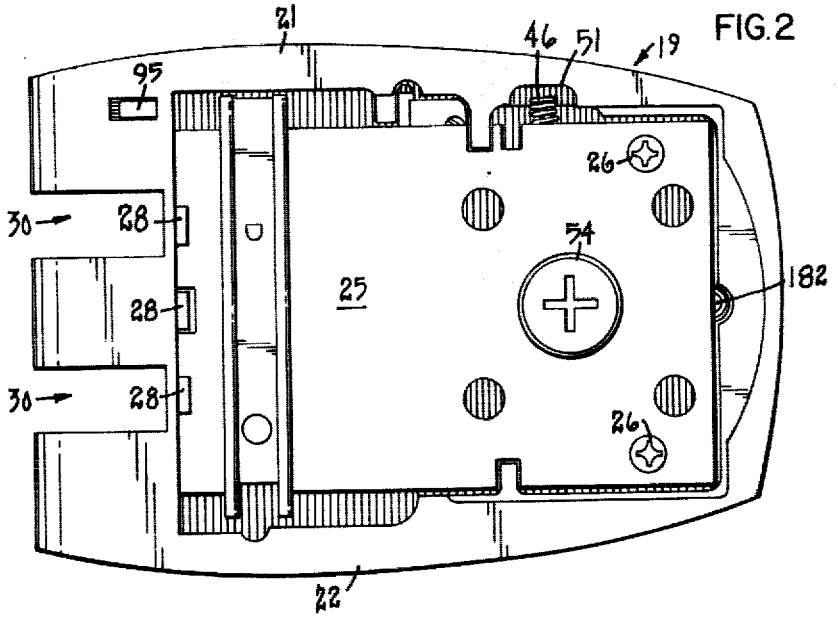
FIG. 2 is a cross-sectional view of the deadlock shown in FIG. 1, particularly illustrating the inside of the deadlock housing with the removable backing plate 25 in place.
Figure 3:
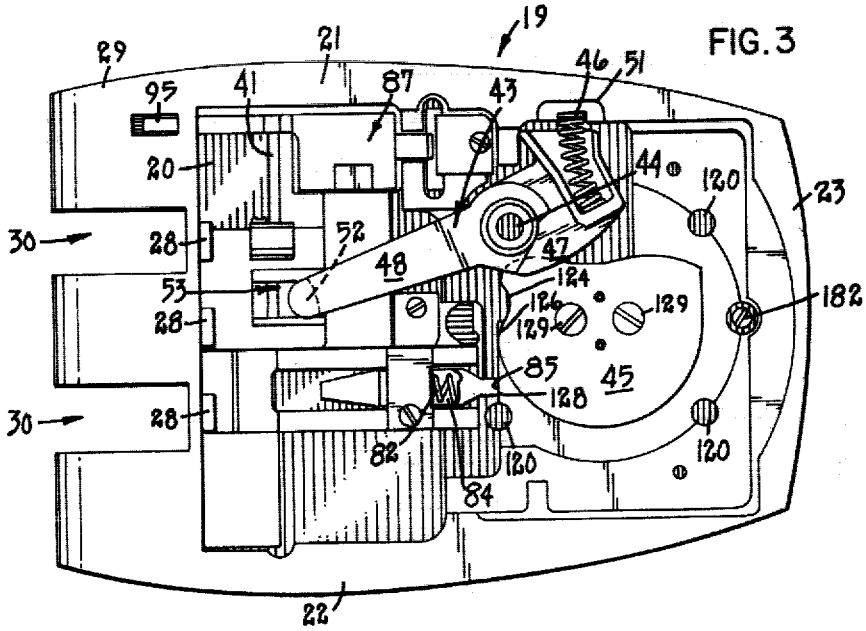
FIG. 3 is a cross-sectional view of the deadlock housing similar to that in FIG. 2 except for the fact that removable plate 25 is removed and the figure illustrates crossbolt 36, drive lever 43, and one of the cams 45 for moving drive lever 43.

Referring briefly to FIGS. 2 and 3, some of the other important components of deadlock 2 include a drive lever 43 which is mounted on a shaft 44 in housing 19. Drive lever 43 has a long lever arm 48 which includes a cylindrical boss 52 received in a recess 53 in crossbolt body 37. A spring 46 extends between a short lever arm 47 of drive lever 43 and a socket 51 in the top wall 21 of housing 19. When crossbolt 36 is in a lower unlocked position in housing 19 (like that shown in FIG. 3), spring 46 is compressed. When crossbolt 36 is freed by the other components of deadlock 2 to allow upward movement of crossbolt 36 into its locked position, the energy stored in spring 46 effects the necessary upward movement.

When crossbolt 36 is in its upper or locked strike engaging position, a retainer member 82, slidably mounted in crossbolt 36, has its outer end 85 located in notches 124 in two identically shaped cams 45. In this position, the outer end 85 of retainer member 82 abuts against a surface 126 to lock the crossbolt 36 in its locked or strike engaging position. See FIG. 3. Crossbolt 36 is unlocked by rotation of either one of the cams 45 in either direction. When such rotation occurs, the areas of the cam adjacent notch 124 cams retainer member 82 back into crossbolt 36 against the force of a biasing spring 84. This rearward camming motion of retainer member 82 continues until outer end 85 no longer abuts against surface 126, but is instead engaged against a vertical surface 128. Crossbolt 36 is then freed to move downwardly to its unlocked position (shown in FIG. 3). This downward movement occurs because continued rotation of cam 45 causes an area 201 on cam 45, which cooperates with and bears against a cam surface on the side of drive lever 43, to rotate drive lever 43 counterclockwise about its shaft 44. Both cams 45 operate independently on drive lever 43 such that rotation of either cam 45 effects rotation of drive lever 43 without causing any change in the position of the other cam 45.

Referring now to FIG. 1, one of the cams 45 is secured to a hub 54. Hub 54 is slotted to receive the end of a lock spindle (not shown) which is coupled to a key operated outer lock cylinder. This outer lock cylinder is mounted within any suitable handle (not shown) on the outside surface of the door. This outer lock cylinder passes generally through the thickness of the door. Thus, the cam 45 secured to hub 54 is rotated by a key inserted on the outside of the door into the outer lock cylinder. The other cam 45 is fixedly secured, using screws 129 to a rotatable inside handle generally indicated as 130.

Figure 7:
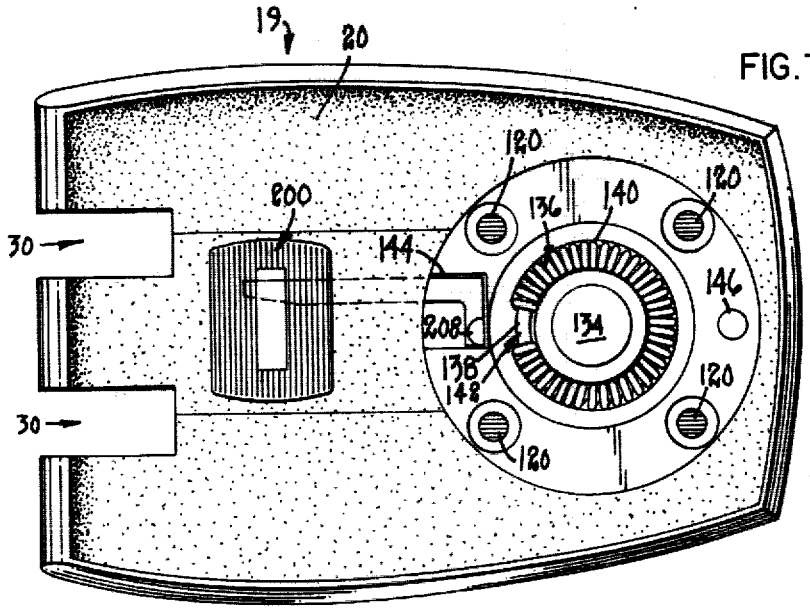
FIG. 7 is a front view of the front face of the deadlock housing of the deadlock shown in FIG. 1, particularly illustrating the front face of the housing with the rotatable handle removed.

Referring now to FIGS. 1 and 7, front face 20 of housing 19 includes a generally circular recess or indentation 132. Recess 132 includes the four apertures or holes 120 through which the threaded securing members extend to hold housing 19 to the door. In addition, recess 132 includes a generally circular bore 134 which communicates with the interior of housing 19. An annular groove or channel 136 surrounds bore 134. Channel 136 includes an enlarged inwardly projecting flange or boss 138. A spring 140 is placed in channel 136 extending all the way around channel 136 except for that portion occupied by boss 138. Thus, an open chamber 142 is positioned in channel 136 which chamber 142 represents that area not occupied by spring 140. Recess 132 also includes a first polygonal opening 144 adjacent one side of channel 136 and a circular opening 146 adjacent the other side of channel 136.

Rotatable handle 130 includes en elongated and tapered handle member 150. Handle member 150 is shaped to allow the person operating the lock to grab the handle member 150 by hand to rotate handle 130. An inwardly projecting stem or hub 152 is attached to handle member 150. Hub 152 terminates in a substantially circular face or bearing member 154. Bearing member 154 has a diameter approximately equal to that of recess 132 to allow bearing member 154 to be rotatably received in recess 132. Bearing member 154 has two U-shaped cut-outs 156 located 180° apart. Normally, when handle 130 is received in recess 132 in the position in which the cams 45 have the retainer member 82 received in notch 124, handle member 150 is substantially horizontal as shown in FIG. 1. In this position, bearing member 154 covers all the apertures 120 for the mounting screws of housing 19.

Figure 5:
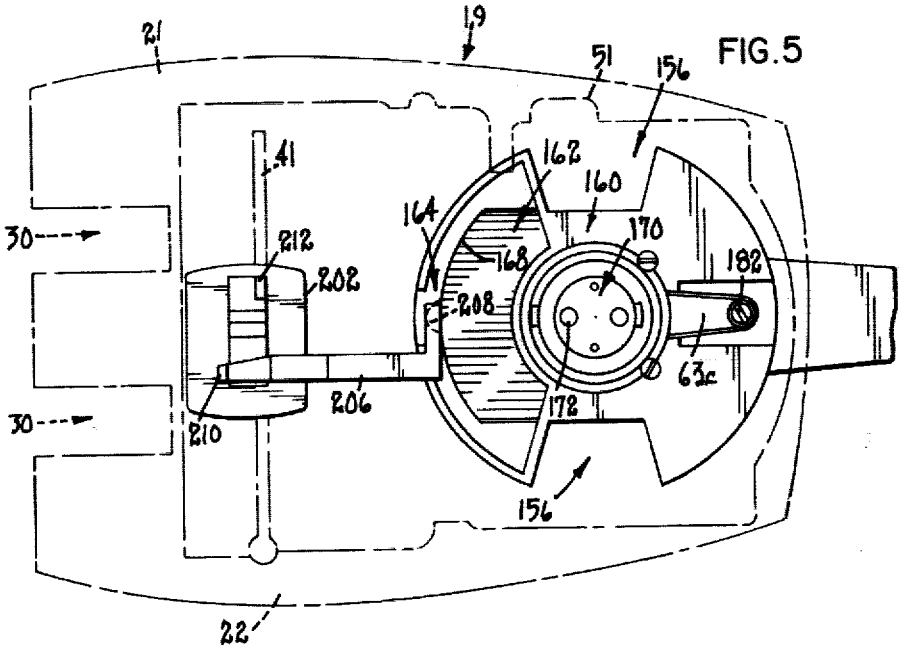
FIG. 5 is a cross-sectional view of the deadlock similar to that in FIG. 4, particularly illustrating a first position of the lock button in which the crossbolt is held in a locked position.
Figure 6:
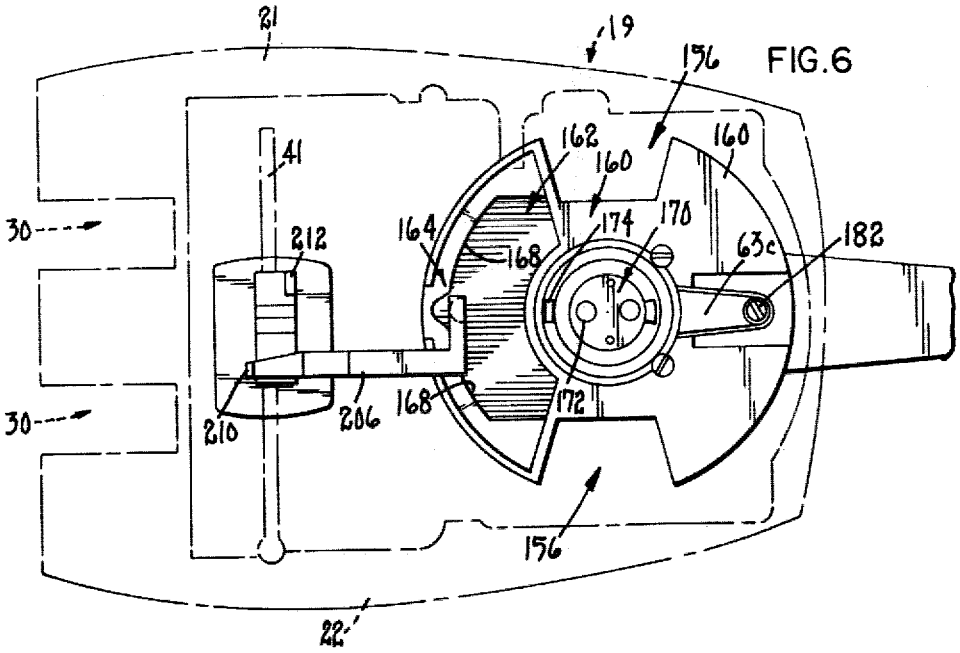
FIG. 6 is a cross-sectional view of the deadlock similar to that shown in FIGS. 4 and 5, particularly illustrating a second position of the lock button in which the crossbolt will automatically relock upon closure of the door.

Referring now to FIGS. 1, 5 and 6, the inner face of bearing member 154 includes a relatively solid land portion 160 and an arcuate recess or cut-out 162. Recess 162 includes a cam 164. Cam 164 includes a notch 166. Identically shaped cam surfaces or cam tracks 168 are located on either side of notch 166. The purpose of cam 164 will be described hereafter. In addition, the inner face of bearing member 154 includes an inwardly projecting circular hub 170. Hub 179 has threaded apertures 172 for receiving the screws 129 which couple cam 45 to handle 130. In addition, a rectangular inwardly extending lug 174 is located on the inner face of bearing member 154. Lug 174 is adapted to be received in the chamber 142 defined in channel 136. When handle member 150 is rotated out of its horizontal position in FIG. 1, lug 174 compresses spring 140 to develop a restoring force for returning handle member 150 to its horizontal position.

Referring now to FIG. 1, two forms of rotatable handle 130 have been illustrated. One embodiment of handle 130 includes an embodiment in which the handle member 150, hub 152 and bearing member 154 are provided with a longitudinal bore 175 therethrough for receiving the components of a conventional lock cylinder 63. The components of lock cylinder 63 are denoted as 63*a*, 63*b*, 63*c*, 63*d*, and 63*e*. These components include a locking pin 182 which is part of component 63*c*. Locking pin 182 is movable into and out of opening 146 in recess 132 upon operation of the key in lock cylinder 63. The other components of lock cylinder 63 are fixed relative to the bore 175 and do not rotate or otherwise actuate cam 45. The apertures 172 may be provided in the inner end of component 63*e* of the locking cylinder 63. The other embodiment of rotatable handle 130 is an embodiment 130' in which a lock cylinder is not provided in the handle 130. In this embodiment of the handle, the hub 170 would simply be integrally and solidly made a part of the inner face of bearing member 154.

Referring now to the remaining components of deadlock 2, these include an actuator lever 87 which holds crossbolt 36 in its retracted or unlocked position whenever the door is open. This is accomplished by a triangular hook or protuberance 90. Hook 90 includes a substantially horizontal bottom surface 91 which engages against a top surface 92 of crossbolt 36 to keep the crossbolt from moving upwardly. In this regard, suitable spring biasing is used to move or bias bottom surface 91 out over surface 92. However, whenever the door is closed, a flange 95 of lever 87, which projects through nose portion 29, engages against the door stop in the door frame. This cams hook 90 back against the spring biasing on lever 87 to a position where it clears the surface 92 and releases crossbolt 36 for upward movement under the force of drive lever 43.

One important aspect of this invention relates to a safety lock or lock button generally illustrated as 200. Lock button 200 includes a generally rectangular body 202. Body 202 is normally located outside of the front face of housing 19 covering a rectangular opening 204 therein. In addition, a laterally projecting arm 206 is connected to the rear face of body 202. Arm 206 is configured such that it is located in the interior of housing 19 in back of front face 20. Arm 206 has an outwardly extending lug or knob 208 on that end of the arm which is distal from body 202. Lug 208 extends out through the opening 144 in recess 132, as shown in FIG. 7, for the purpose of cooperating with cam 164 on handle 130.

The rear face of body 202 also includes two locking lugs 210 and 212. One of these lugs 210 is located on the inner end of arm 206. The other lug 212 is both vertically and laterally offset on body 202 relative to the lug 210. Both of the locking lugs 210 and 212 can be aligned with the guide channel 41 where they can cooperate with the notch 106 in crossbolt 36 for locking the crossbolt in either its locked or unlocked position.

Lock button 200 also includes a leaf spring 108 secured to the rear face of body 202. Spring 108 is formed with a detent. This detent is adapted to cooperate with one of three vertical notches or grooves 109 on the inside surface of housing 19. See FIG. 4. Thus, lock button 200 can be releasably held in any one of three positions relative to housing 19.

Figure 4:
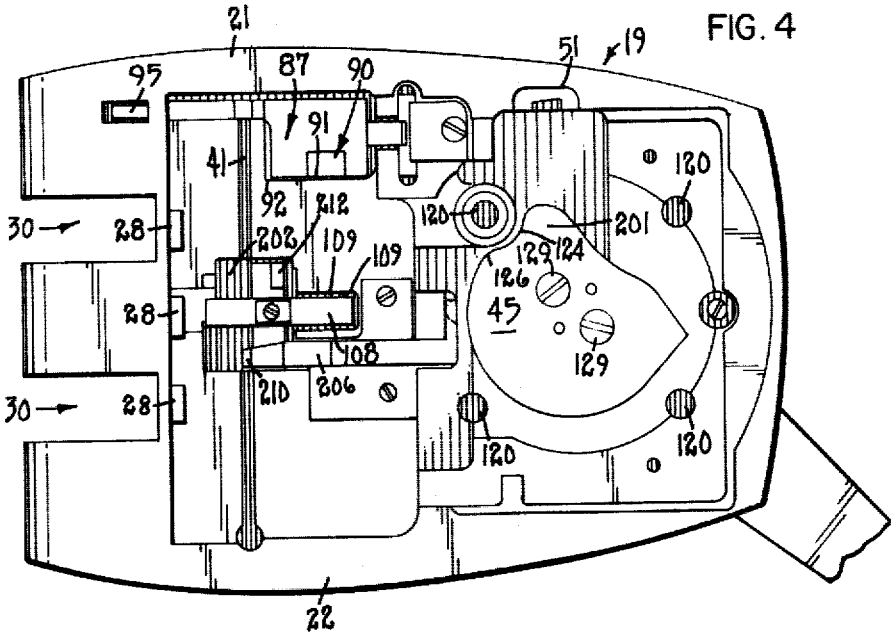
FIG. 4 is a cross-sectional view of the improved deadlock similar to FIGS. 2 and 3, particularly illustrating a third position of the lock button in which the crossbolt is held in an open or retracted position after the door has been opened by rotation of the handle.

Referring now to FIGS. 4–6, FIG. 5 represents the orientation of handle 130 and lock button 200 when the door is closed and when the crossbolt 36 is in its upper or locked position. In this position of crossbolt 36, lock button 200 is in what will be referred to as its first position. In this position, locking lug 212 is in alignment with and is received inside notch 106 in crossbolt 36 to positively hold or lock the crossbolt in its locked strike engaging position. This is the so-called security position of lock button 200 or the key lock out position. It is impossible to unlock or move crossbolt 36 even with a key. It is first required, as in other deadlocks of this type, that lock button 200 be laterally shifted out of this position. In the first position of lock button 200, the lug 208 is received in notch 166 of cam 164.

Now assuming that someone wishes to open the door and unlock deadlock 2, any rotation of handle 130 will cause the lug 208 to ride up onto one of the cam surfaces or cam tracks 168. This laterally slides lock button 200 from its first position as shown in FIG. 5, to a second position, shown in FIG. 6, and then to a third position, shown in FIG. 4. The second position is illustrated in FIG. 6 as one in which neither of the locking lugs 210 or 212 is aligned with the groove 41 or with the rail 40 of crossbolt 36. This would then allow crossbolt 36 to be unlocked since rotation of cam 45 will unlock retainer member 82 and cause downward movement of crossbolt 36. Movement of lock button 200 also continues in an uninterrupted manner during rotation of handle 130 into the third position illustrated in FIG. 4. In this position, locking lug 210 on the lock button 200 has entered the notch 106 in the crossbolt 36 to hold the crossbolt in its lower or unlocked position. Lug 210 is effective to enter into notch 106, even though it is vertically offset from lug 212, because crossbolt 36 has dropped down from its upper locked position to its lower or unlocked position and notch 106 is correspondingly also moved downward. In this third position of lock button 200, crossbolt 36 cannot relock, even if the door is inadvertently closed and actuator lever 87 actuated, since the crossbolt 36 is positively held in its unlocked position.

Deadlock 2 has numerous advantages related to lock button 200 as disclosed herein. For example, considering a panic exit type situation, it is only required that handle 130 be turned in order to unlock the crossbolt 36. It is no longer required that the lock button be manually unlocked first. In addition, the rotation of handle 130 automatically moves lock button 200 into its third position in which crossbolt 36 will be held in its unlocked position. Thus, movement of handle 130 to open the door also automatically places lock button 200 into the anti-lock out position. One cannot be locked out by subsequent reclosing of the door. Furthermore, lock button 200 moves in a linear or straight line from its first to its third position passing through its second position on the way. This is an improvement over prior art crossbolts in which the cross button had to be manually moved back to a locked position in a direction reverse of what was first required to unlock the door to provide the anti-lock out feature. Thus, lock button 200 according to this invention is safer and more foolproof in operation both in terms of a panic exit and an anti-lock out feature.

Notwithstanding the above, deadlock 2 can be placed into a condition which would allow the automatic relocking of crossbolt 36 whenever the door is closed simply by placing the lock button into its second position. In this second position, neither of the lugs 210 or 212 are in engagement with crossbolt 36. The crossbolt is free to move vertically. Thus, when the door closes and hook 90 on the actuator lever 87 is removed from engagement with the crossbolt, the drive force of drive lever 43 is effective to vertically raise crossbolt 36 and place it into its locked position. Thus, the only time the lock button needs to be manually operated is to place it into its second or middle position in order to allow automatic relocking of the crossbolt. This is a safer and more fool-proof operation than one in which manual operation is required first to unlock the door and to then place the lock button in condition for the anti-lock out feature.

The provision of the handle 130 having a lock cylinder 63 therein is also advantageous. It is the first time to applicant's knowledge that any type of automatically locking crossbolt deadlock of this type has been provided with a rotatable handle which also incorporates a lock cylinder. The provision of the lock cylinder 63 with the cam 45 being fixedly carried on the end thereof and the lock cylinder being fixedly carried in the handle 130 allows operation of retainer member 82 and the crossbolt 36 in a normal manner.

Various modifications of this invention will be apparent to those skilled in the art. Thus, the scope of this invention is to be limited only by the appended claims.

What is claimed is:

1. An automatically locking crossbolt deadlock suited for attachment to a door, wherein the deadlock is of the type having a crossbolt movable between an unlocked position and a locked position in which the crossbolt engages a strike, a lock button movable between a first position in which the lock button positively holds the crossbolt in its locked position, a second position in which the crossbolt is free to move between its locked and unlocked positions, and a third position in which the lock button positively holds the crossbolt in its unlocked position to prevent automatic relocking of the crossbolt upon closing of the door, and means for moving the crossbolt between its locked and unlocked positions, wherein the moving means includes a rotatable handle, and wherein the improvement relates to the lock button and comprises:

means for moving the lock button from its first to its second position upon rotation of the handle, whereby movement of the lock button is automatically effected upon rotation of the handle to allow unlocking of the crossbolt without the need for first manually moving the lock button from its first to its second position, and for moving the lock button from its second to its third position upon further rotation of the handle such that the lock button is placed into its third position when the handle is rotated to unlock the crossbolt.

2. A deadlock as recited in claim 1, wherein the moving means comprises a cam carried by the handle, wherein the cam is in engagement with the lock button and is configured to move the lock button from its first to its second position as the handle rotates.

3. A deadlock as recited in claim 2, wherein the cam is also configured to move the lock button from its second to its third position upon further rotation of the handle and after the second position of the lock button has been reached by initial rotation of the handle.

4. A deadlock as recited in claim 2, which further includes a housing in which the crossbolt and lock button are contained, wherein the housing includes a front face having a recess through which a lug on the lock button extends, wherein the handle is received for rotation in the recess with the cam located on an inside surface of the handle for engagement with the lug.

5. An automatically locking crossbolt deadlock suited for attachment to a door, wherein the deadlock is of the type having a crossbolt which is movable between an unlocked position and a locked position in which the crossbolt engages the strike, a lock button for engagement with the crossbolt for holding the crossbolt in either an unlocked or locked position, means for moving the crossbolt between its unlocked and locked positions which moving means includes a rotatable handle, and wherein the improvement relates to the lock button and comprises:

a lock button which is slidably movable relative to the housing through first, second and third positions, wherein the lock button in its first position engages and holds the crossbolt in its locked position, wherein the lock button in its second position is not in engagement with the crossbolt to allow the crossbolt to be automatically relocked upon closing of the door to which the deadlock is attached, and wherein the lock button in its third position is in engagement with the crossbolt to hold the crossbolt in an unlocked position to prevent automatic relocking of the crossbolt upon reclosing of the door and thus define an anti-lock-out mode, and wherein the first, second, and third positions of the lock button are consecutively reached as the lock button moves in a single direction.

6. A deadlock as recited in claim 5, wherein the crossbolt has a single notch into which locking lugs on the lock button extends for holding the crossbolt in either an unlocked or locked position, wherein the lock button has two such locking lugs which locking lugs are both vertically and longitudinally offset on the lock button, whereby one locking lug is configured to fit into the notch when the lock button is in its first position and the crossbolt is in its locked position and the other locking lug is configured to fit into the notch when the lock button is in its third position and the crossbolt is in its unlocked position.

7. A deadlock as recited in claim 6, further including means operated by rotation of the handle for automatically moving the lock button from its first to its second position to allow movement of the crossbolt out of its locked position and for moving the lock button from its second to its third position to positively hold the crossbolt in its unlocked position, whereby manual operation of the lock button is not required to unlock the crossbolt or place it into the anti-lock mode.

8. An automatically locking crossbolt deadlock of the type which includes a housing having a front face, a recess substantially circular in the front face of the housing, a rotatable handle secured to the front face of the housing for operating a movable crossbolt contained inside the housing, wherein the crossbolt is movable between an unlocked position and a locked position in which the crossbolt engages the strike, wherein the handle includes a hub which fits into the recess of the housing, and wherein the improvement relates to the handle and comprises:

a lock cylinder contained inside the hub of the handle, wherein the lock cylinder includes a locking pin which is movable towards and away from the front face of the housing upon operation of the lock cylinder, and wherein the recess includes an opening into which the locking pin is received for preventing rotation of the handle with rotation of the handle allowed only upon removal of the locking pin from the opening.

* * * * *